United States Patent [19]

Jackson, Jr.

[11] Patent Number: 4,916,917

[45] Date of Patent: Apr. 17, 1990

[54] REFRIGERATED CASE EXTENDER

[76] Inventor: McSwain L. Jackson, Jr., Rte. 2, Box 18, Puryear, Tenn. 38251

[21] Appl. No.: 400,793

[22] Filed: Aug. 28, 1989

[51] Int. Cl.[4] ..... A47F 3/04

[52] U.S. Cl. ..... 62/249; 62/252; 62/256; 211/88; 312/140.4

[58] Field of Search ..... 62/249, 252, 255, 256, 62/246; 312/236, 116, 140.4; 211/88, 90

[56] References Cited

U.S. PATENT DOCUMENTS 2,303,724 12/1942 Conrad ..... 62/255

3,548,610 12/1970 Kendall et al. ..... 62/256

3,552,138 1/1971 Davis ..... 62/252 X 4,085,986 4/1978 Taub ..... 62/255 X

*Primary Examiner*—William E. Tapolcai

*Attorney, Agent, or Firm*—Harrington A. Lackey

[57] ABSTRACT

A display case extender adapted to be mounted upon and in front of the front case wall of an existing refrigerated grocery case, including a display bin for displaying groceries in front of the grocery case and an air intake duct system for drawing cool air from the refrigerated case behind the front case wall to a discharge outlet for discharging cool air at the rear and above the display bin, and an exhaust duct system for drawing the warmer air from the front of the display bin back across the front case wall to a return air intake in the front case wall.

11 Claims, 2 Drawing Sheets

FIG. 2
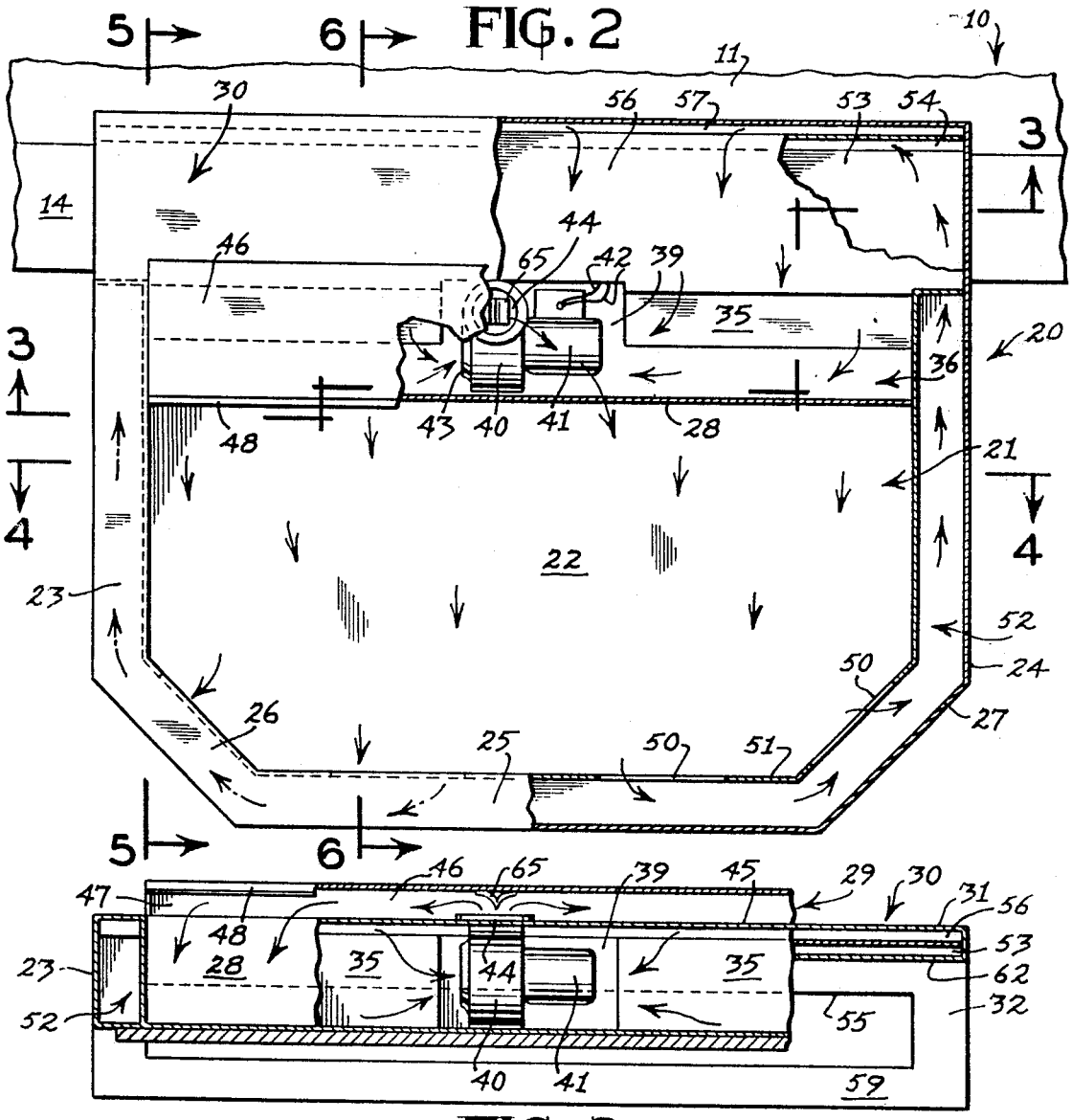
FIG. 3
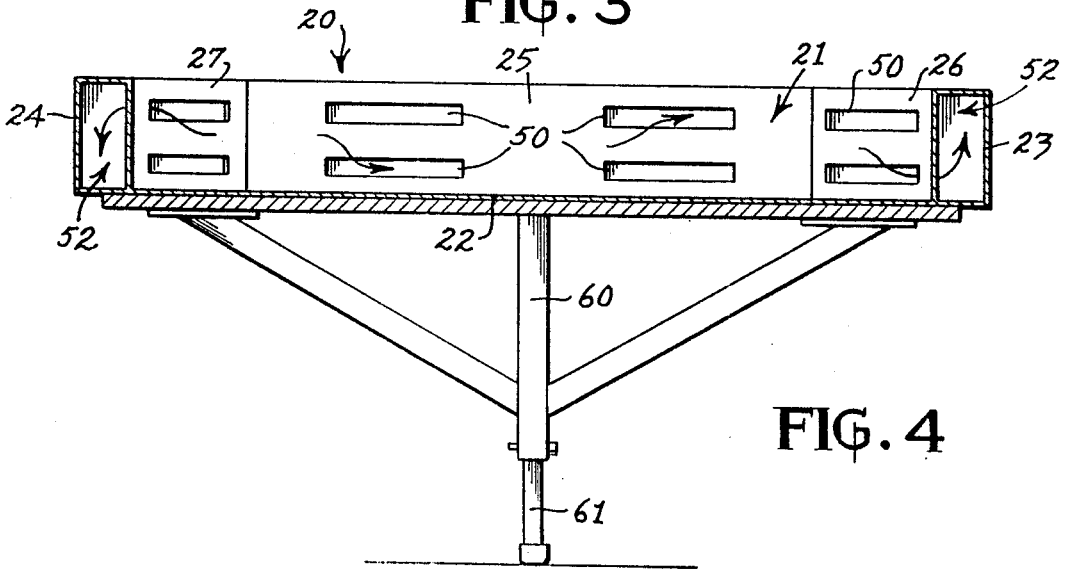
FIG. 4

REFRIGERATED CASE EXTENDER

BACKGROUND OF THE INVENTION

This invention relates to a display case extender for a refrigerated grocery case, and more particularly to a refrigerated case extender.

Non-refrigerated case extenders are well known in the art, and include various types of trays or bins adapted to be mounted or hooked over and in front of the front case wall of an existing refrigerated grocery case in order to provide a more economical auxiliary storage space for the grocery products.

U.S. Pat. No. 2,528,916 issued to Shreve on Nov. 7, 1950 discloses a lower refrigerated case or bin having an upper shelf over which cooled air from the lower bin or shelf is circulated.

The Davis U.S. Pat. No. 3,552,138 issued Jan. 5, 1971 discloses a "REFRIGERATED DISPLAY UNIT", which is an auxiliary display case mounted in front of and against the front case wall of a conventional or existing refrigerated grocery case. A U-shaped conduit is fitted over the back wall of the auxiliary case and the front wall of the existing case and is provided with some type of pump for moving cool air from the front portion of the existing case into the rear portion of the auxiliary case. However, in all four embodiments of the auxiliary display case disclosed in the Davis patent, the warmer air in the auxiliary case is discharged through exhaust openings in the front wall of the auxiliary case to the ambient air. There is no provision in the Davis auxiliary display units for returning the spent or warm air to the refrigeration circulation system of the existing grocery display case.

SUMMARY OF THE INVENTION

It is therefore an object of this invention to provide a display case extender adapted to be mounted upon and in front of an existing refrigerated grocery case, the case extender being adapted to hold and display the overflow products from the existing grocery case and also to cool these products without an additional refrigerating apparatus.

Another object of this invention is to provide a display case extender for mounting on the front of an existing refrigerated grocery display case in which the products displayed in the case extender are cooled by air which is refrigerated in the existing grocery case, transferred to the case extender, and returned to the refrigeration system of the grocery case.

A further object of this invention is to provide a display case extender for a refrigerated grocery case in which an air intake system moves air from the front portion of the grocery case over the front case wall and over the top of the products displayed in the display bin of the case extender and which is also provided with a return and exhaust duct system for transferring the spent or warmer air from the front portion of the display bin back across the front wall and into the return air circulation system of the grocery case.

The case extender, made in accordance with this invention, includes a display bin having hollow front and side walls constituting a return air duct system in communication with an exhaust chamber behind the bin, which in turn is connected by an exhaust duct system passing from the exhaust chamber across the top wall and into registry with the existing return air vent or opening in the front wall. A separate air intake duct system extends from the interior of the grocery case across the top wall and into an air intake chamber in communication with a discharge outlet located above and behind the display bin for discharging air forward and downward over the grocery products within the display bin.

It is another object of this invention to provide a display case extender for an existing grocery case which includes a complete circulation duct system for drawing cool air from the grocery case, cooling the products within the case extender and returning the spent air to the grocery case, without any additional refrigeration equipment, except a blower or fan.

BRIEF DESCRIPTION OF THE DRAWINGS

FIG. 2 is an enlarged top plan view of the case extender disclosed in FIG. 1, mounted upon the front wall of the grocery case, shown fragmentarily, with various portions broken away to illustrate the air flow;

FIG. 3 is a sectional elevation taken along the line 3—3 of FIG. 2 of the display case extender, with portions broken away;

FIG. 4 is a sectional elevation taken along the line 4—4 of FIG. 2;

DESCRIPTION OF THE PREFERRED EMBODIMENTS

Figure 1:
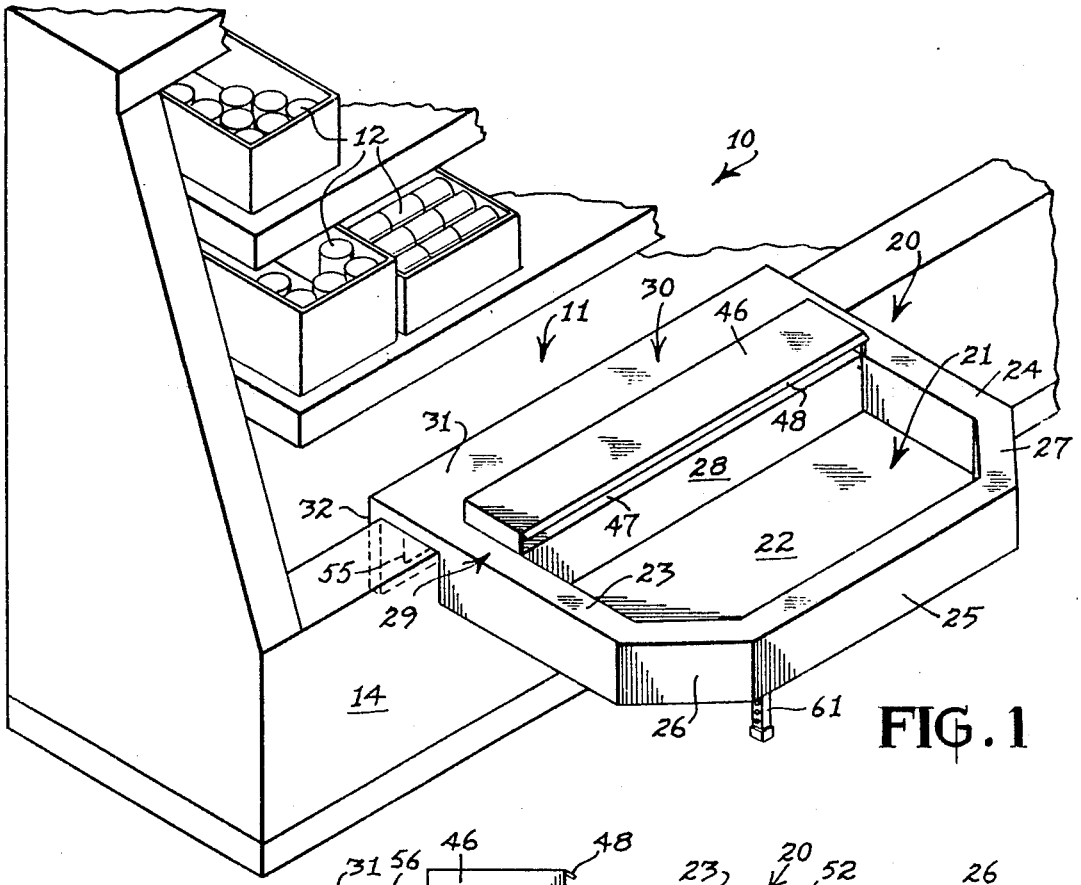
FIG. 1 is a top front perspective view of the display case extender made in accordance with this invention mounted on the front wall of an existing refrigerated grocery case, shown fragmentarily.
Figure 6:
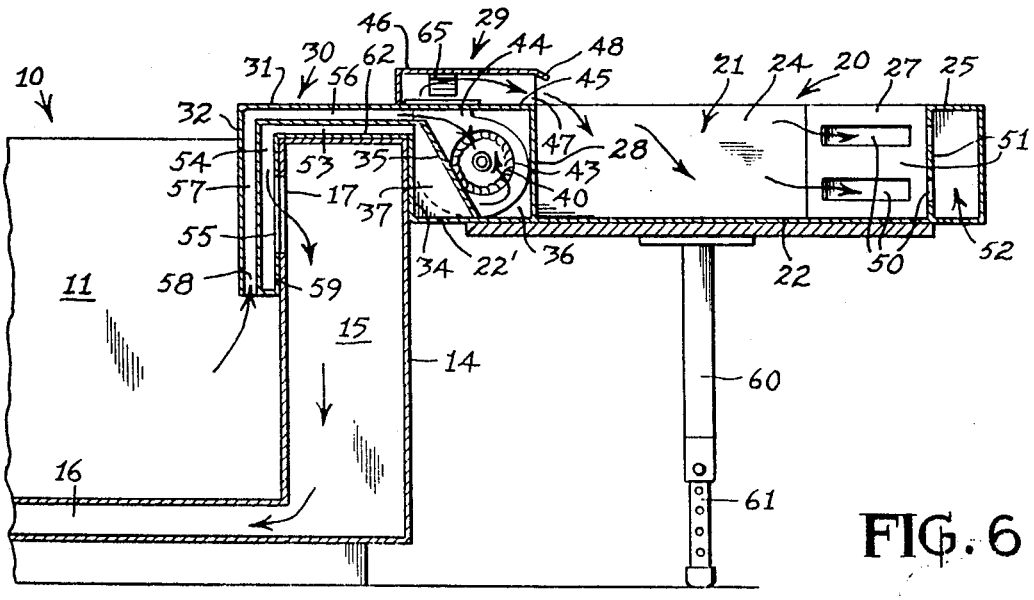
FIG. 6 is a fragmentary sectional elevation taken along the line 6—6 of FIG. 2 of the case extender and the front portion of the grocery case.

Referring now to the drawings in more detail, FIGS. 1 and 6 disclose fragmentary portions of an existing conventional refrigerated grocery case 10 having a display chamber 11 for receiving and displaying grocery products, such as 12, in an environment of cool or cold air. Conventional refrigerated grocery cases incorporate a refrigeration system which usually circulates cold air, from the upper rear portion of the grocery case downward and forward to cool or freeze products within the display chamber 11. Most grocery cases 10 incorporate an elongated transverse upright front case wall 14, which is preferably hollow, as disclosed in FIG. 6, to include a return air plenum 15 communicating through a return duct 16 in the bottom of the display chamber 11 with the refrigeration apparatus or cooling heat exchanger, not shown, in order to re-cool and re-circulate the air within the display chamber 11. Formed in the rear face of the front case wall 14 is a return air intake opening 17, through which the spent or warm air normally passes after it has passed over the grocery products 12.

The case extender 20 made in accordance with this invention includes an open-top display bin 21 defined by a bottom wall 22, opposite hollow side wall members 23 and 24, a hollow front wall member 25, opposite hollow front corner wall members 26 and 27, and a rear wall 28.

Behind the rear wall 28 of the bin 21 is an air processing plenum 29 which extends transversely preferably the full width of the extender 20. Projecting rearwardly from the air processing plenum 29 is a hanger member 30 including a horizontal hanger portion 31 and a depending leg member 32.

The rear wall 28 of the display bin 21 also constitutes the front wall of the air processing plenum 29. Moreover, the bottom wall 22 projects rearwardly to also form the bottom wall of the air processing plenum 29. The back wall 34 of the air processing plenum 29 projects upward from the bottom wall extension 22' to join the horizontal portion 31 of the hanger member 30. Extending transversely of the air processing plenum 29 between the wall 28 and the back wall 34 is an elongated downwardly and forwardly sloping diagonal partition wall 35, which generally separates the air processing plenum 29 into an air intake chamber 36 forward of the partition wall 35 and an air exhaust chamber 37 to the rear of the partition wall 35.

As best disclosed in FIGS. 2 and 3, the middle portion of the sloping or diagonal partition wall 35 is recessed rearwardly to form a blower chamber 39 for receiving an air blower or fan 40. The blower or fan 40 may be driven by an electrical motor 41 connected by leads 42 to a source of electricity, not shown.

The intake 43 of the fan 44 is in fluid communication with the air within the air intake chamber 36. The fan outlet 44 projects through a corresponding opening in the top wall 45 of the air intake chamber 36 to introduce the air discharged from the fan 44 into an air discharge chamber 46. An elongated transverse air discharge outlet 47 is formed transversely through the front of the air discharge chamber 46 and is located above the rear wall 28 of the bin 41. A transverse deflector 48 sloping forward and downward above the discharge outlet 47 directs cool air from the air discharge chamber 46 down into the rear portion of the display bin 21, as best illustrated by the arrows in FIG. 6.

Figure 5:
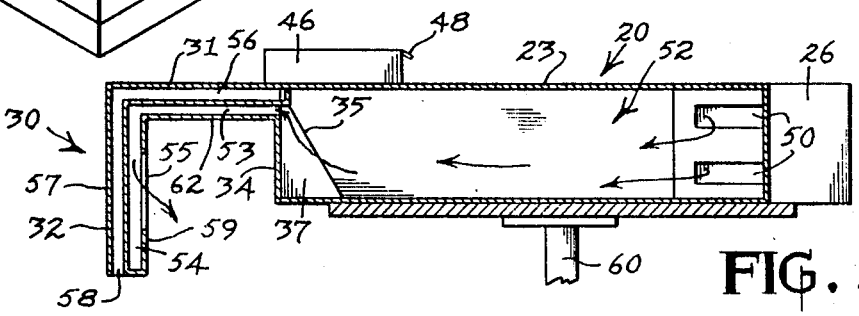
FIG. 5 is a sectional elevation of the case extender, taken along the line 5—5 of FIG. 2.

The cool air from the discharge outlet 47 descends into the display bin 21 and over and around any grocery products within the bin 21. The air then flows toward and passes through the return air intake vents 50 formed through the inside or interior panels or walls of the hollow front wall member 25 and the hollow corner wall members 26 and 27. The hollow side wall members 23 and 24, the corner wall members 26 and 27, and the front wall member 25 define a continuously open return air duct 52, which carries the air introduced into the wall members through the return air vents 50 rearward into the exhaust chamber 37, as best illustrated in FIGS. 2 and 5.

After entering the exhaust chamber 37, the warmer returned air is diverted upward between the partition wall 35 and the back wall 34 to pass through an exhaust duct formed within the hanger member 30. The exhaust duct includes a horizontal duct portion 53 extending the full width of the extender 20 and a vertical exhaust duct portion 54 within the depending leg 32. The air from the vertical exhaust duct portion 54 is discharged through an elongated transverse exhaust air outlet 55 facing forward and in fluid communication with the return air intake opening 17 formed in the front case wall 14, as best illustrated in FIG. 6.

The hanger member 30 also includes an air intake duct which extends transversely substantially the full width of the extender 20 and includes a horizontal intake duct portion 56 and a rear depending vertical intake duct portion 57, the lower end of which is provided with an opening 58 which is in fluid communication with the cool air within the refrigerated display chamber 11. Preferably, the horizontal and vertical portions 56 and 57 of the intake duct have their fluid paths parallel and above and rearwardly of the corresponding fluid paths of the exhaust duct portions 53 and 54, respectively, as best illustrated in FIGS. 5 and 6.

The horizontal intake duct portion 56 is in fluid communication with the upper portion of the air intake chamber 36. Thus, when the fan 40 is operated, air is drawn through the intake opening 58, the intake duct portions 57 and 56, into the air intake chamber 36, where the fan 44 pulls the air through the fan intake 43 and discharges the cool air through the fan discharge outlet 44 into the air discharge chamber 46. The air is then discharged through the outlet 47 and deflected downwardly by the deflector 48 across the top of the display bin 41 to cool the products within the display bin 21. The warmer or spent air is then discharged through the vents 50 and into the return air duct 52 formed in the hollow wall members 25, 26, 27, 23, and 24 where the air is returned to the air exhaust chamber 37 and thence through the exhaust duct portions 53 and 54 and the air exhaust outlet 55 through the return intake opening 17 into the return plenum 15 of the front case wall 14. The air is then re-circulated through the existing circulating and refrigerating system within the case 10. The air is then recooled within the refrigerating system of the grocery case 10 and spread over the products within the case 10. Cool air is picked up in front of the case 10 by the air intake outlet 58, and the entire cycle repeated.

In a preferred form of the invention, the front wall 59 of the depending leg member 32 is spaced from the back wall 34 approximately the same distance as the thickness of the front case wall 14, so that the hanger member 30 will preferably fit snugly atop of and along both upper face portions of the front case wall 14 to facilitate the mounting of the case extender 20 upon the front case wall 14, as best illustrated in FIGS. 1 and 6.

Also in a preferred form of the invention, the bottom wall 22 of the display bin 21 is further supported by a leg or pedestal 60, which may have a telescoping portion 61, as illustrated in FIGS. 4 and 6.

As is self-evident, from FIG. 6, the bottom wall 62 of the horizontal leg potion 31 is also adpated to seat flush upon the top surface of the front case wall.

Moreover, an air deflector 65 may depend from the middle of the top wall of the air discharge chamber 46 to afford a greater transverse distribution of air, if desired.

It is therefore believed that a refrigerated case member 20 has been provided which is portable, and which may be easily mounted and dismounted upon the front case wall 14 of a refrigerated grocery case 10 for not only displaying, but also adequately cooling overflow food products, which could normally not be displayed, or which would be overcrowded, in the existing grocery case 10.

Furthermore, a refrigerated case extender 20 has been provided which not only utilizes the already refrigerated air within the existing grocery case 10, but also returns the spent or warm air to the existing return air circulation system for the grocery case 10.

Furthermore, a display case extender 20 has been provided which will adequately display and cool overflow grocery products without requiring additional refrigerating equipment, and only requires a small blower or fan to assist in the circulation of the cool and the spent air.

What is claimed is:

1. A display case extender for attachment to a refrigerated grocery case having an upright front case wall including a return air plenum communicating with a return air intake opening on the rear face of the front case wall, and a display chamber containing cool air behind the front case wall, comprising:

(a) a display bin having a bottom wall, opposed side walls, a front wall and a rear wall enclosing a display storage chamber, and having an open top, (b) means for supporting said display bin in an elevated operative position in front of the front case wall of a refrigerated grocery case, (c) an air intake chamber behind said rear wall having an air intake duct extending across and downward behind the front case wall of a refrigerated grocery case when said display bin is in said operative position, whereby said air intake duct communicates with the cool air in the display chamber of the grocery case, (d) said air intake chamber having a discharge outlet in the upper and rear portion of said display bin, (e) blower means for moving cool air from the display chamber through said intake duct, said air intake chamber and said discharge outlet into said open display bin, (f) an air exhaust chamber behind said rear wall having an air exhaust duct extending across and downward behind the front case wall of a refrigerated grocery case and in communication with the return air intake opening of said front case wall when said display bin is in said operative position, and (g) a return-air intake vent in one of said walls of said display bin in fluid communication between said display bin and said exhaust chamber.

2. The invention according to claim 1 further comprising a return air duct in fluid communication between said return air intake vent and said exhaust chamber.

3. The invention according to claim 2 further comprising a plurality of said air intake vents in said front wall, each of said air intake vents being in fluid communication with said return air duct.

4. The invention according to claim 3 in which said front and side walls are hollow and in continuous fluid communication with each other and said air intake vents to define said return air duct communicating with said exhaust chamber.

5. The invention according to claim 1 in which said air intake vent is below said discharge outlet, in said operative position.

6. The invention according to claim 1 in which said air exhaust duct has an exhaust air outlet facing forward and registering with the return air intake opening in the front case wall, in said operative position.

7. The invention according to claim 6 in which said air intake duct extends above and behind said air exhaust duct over the front case wal in operative position.

8. The invention according to claim 7 in which said exhaust chamber has a back wall and said air exhaust duct has a vertical front wall portion and a horizontal top wall portion, said back wall, and said front and top wall portions of said air exhaust duct defining an inverted U-shaped channel adapted to fit over and upon the top portion of the front case wall in operative position.

9. The invention according to claim 8 in which said rear wall of said display bin defines the front wall of said air intake chamber, and further comprising a transverse partition wall between said rear wall and said back wall to separate said air intake chamber from said exhaust chamber.

10. The invention according to claim 9 in which said blower means is mounted within said air intake chamber.

11. The invention according to claim 10 further comprising an air discharge plenum above and in fluid communication with said air intake chamber, said discharge outlet defining the outlet of said air discharge plenum and located substantially above said rear wall for discharge of air downward into the rear portion of said display bin.

* * * * *